US007785280B2

(12) United States Patent
Kivisto

(10) Patent No.: US 7,785,280 B2
(45) Date of Patent: Aug. 31, 2010

(54) VARIABLE STROKE AIR PULSE GENERATOR

(75) Inventor: John A. Kivisto, Oak Grove, MN (US)

(73) Assignee: Hill-Rom Services, Inc., Wilmington, DE (US)

( * ) Notice: Subject to any disclaimer, the term of this patent is extended or adjusted under 35 U.S.C. 154(b) by 910 days.

(21) Appl. No.: 11/539,710

(22) Filed: Oct. 9, 2006

(65) Prior Publication Data

US 2007/0239087 A1 Oct. 11, 2007

Related U.S. Application Data

(60) Provisional application No. 60/726,554, filed on Oct. 14, 2005.

(51) Int. Cl.
*A61H 31/00* (2006.01)
*A61H 31/02* (2006.01)

(52) U.S. Cl. ..... 601/41; 601/43; 601/44; 601/148; 601/149; 601/150; 601/151; 601/152

(58) Field of Classification Search ..... 601/41–44, 601/148–152
See application file for complete search history.

(56) References Cited

U.S. PATENT DOCUMENTS

| | | | |
|---|---|---|---|
| 402,779 | A | 5/1889 | Steinhoff |
| 1,646,590 | A | 10/1927 | Mildenberg |
| 2,354,397 | A | 7/1944 | Miller |
| 2,436,853 | A | 3/1948 | Coleman |
| 2,486,667 | A | 11/1949 | Meister |
| 2,588,192 | A | 3/1952 | Akerman et al. |
| 2,626,601 | A | 1/1953 | Riley |
| 2,762,366 | A | 9/1956 | Huxley, III et al. |
| 2,772,673 | A | 12/1956 | Huxley, III |
| 2,779,329 | A | 1/1957 | Huxley, III et al. |
| 2,780,222 | A | 2/1957 | Polzin et al. |
| 2,818,853 | A | 1/1958 | Huxley, III et al. |
| 2,832,335 | A | 4/1958 | Huxley, III et al. |
| 2,869,537 | A | 1/1959 | Chu |
| 3,043,292 | A | 7/1962 | Mendelson |
| 3,053,250 | A | 9/1962 | Stubbs |
| 3,063,444 | A | 11/1962 | Jobst |
| 3,120,228 | A | 2/1964 | Huxley, III |
| 3,291,123 | A | 12/1966 | Terauchi |
| 3,310,050 | A | 3/1967 | Goldfarb |
| 3,333,581 | A | 8/1967 | Robinson et al. |

(Continued)

OTHER PUBLICATIONS

"Volume Controlled Ventilators", Hugo Sachs Elektronik-Harvard Apparatus GmbH, published prior to Aug. 29, 2003, six pages.

(Continued)

*Primary Examiner*—Loan H Thanh
*Assistant Examiner*—Valerie Skorupa
(74) *Attorney, Agent, or Firm*—Barnes & Thornburg LLP

(57) ABSTRACT

An apparatus for high frequency chest wall oscillation (HFCWO) comprises a patient interface which includes an expandable air chamber and an air pulse generator in fluid communication with the patient interface. The air pulse generator includes a variable displacement air chamber and programmable controller which controls the air pulse generator to vary the frequency and volume of air pulses delivered to the patient interface such that HFCWO therapy may be programmed for a particular patient.

19 Claims, 4 Drawing Sheets

U.S. PATENT DOCUMENTS 3,460,531 A 8/1969 Gardner
3,536,063 A 10/1970 Werding
3,566,862 A 3/1971 Schuh et al.
3,683,655 A 8/1972 White et al.
3,742,939 A 7/1973 Sayer
3,760,801 A 9/1973 Borgeas
3,802,417 A 4/1974 Lang
3,896,794 A 7/1975 McGrath
3,993,053 A 11/1976 Grossan
4,003,373 A 1/1977 Spelio
4,051,843 A 10/1977 Franetzki et al.
4,079,733 A 3/1978 Denton et al.
4,098,266 A 7/1978 Muchisky et al.
4,133,305 A 1/1979 Steuer
4,311,135 A 1/1982 Brueckner et al.
4,326,507 A 4/1982 Barkalow
4,349,015 A 9/1982 Alferness
4,397,306 A 8/1983 Weisfeldt et al.
4,398,531 A 8/1983 Havstad
4,424,806 A 1/1984 Newman et al.
4,429,688 A 2/1984 Duffy
4,453,538 A 6/1984 Whitney
4,546,764 A 10/1985 Gerber
4,621,621 A 11/1986 Marsalis
4,624,244 A 11/1986 Taheri
4,676,232 A 6/1987 Olsson et al.
4,697,580 A 10/1987 Terauchi
4,815,452 A 3/1989 Hayek
4,838,263 A * 6/1989 Warwick et al. ..... 601/44
4,881,527 A 11/1989 Lerman
4,886,057 A 12/1989 Nave
4,887,594 A 12/1989 Siegel
4,928,674 A 5/1990 Halperin et al.
4,971,042 A 11/1990 Lerman
4,977,889 A 12/1990 Budd
4,982,735 A 1/1991 Yagata et al.
5,056,505 A 10/1991 Warwick et al.
5,076,259 A 12/1991 Hayek
5,101,808 A 4/1992 Kobayashi et al.
5,167,226 A 12/1992 Laroche et al.
5,181,504 A 1/1993 Ono et al.
5,193,745 A 3/1993 Holm
5,222,478 A 6/1993 Scarberry et al.
5,235,967 A 8/1993 Arbisi et al.
5,261,394 A 11/1993 Mulligan et al.
5,299,599 A 4/1994 Farmer et al.
5,334,131 A 8/1994 Omandam et al.
5,360,323 A 11/1994 Hsieh
5,453,081 A 9/1995 Hansen
5,455,159 A 10/1995 Mulshine et al.
5,496,262 A 3/1996 Johnson, Jr. et al.
5,508,908 A 4/1996 Kazama et al.
5,569,122 A 10/1996 Cegla
5,606,754 A 3/1997 Hand et al.
5,720,709 A 2/1998 Schnall
5,738,637 A 4/1998 Kelly et al.
5,769,797 A 6/1998 Van Brunt et al.
5,769,800 A 6/1998 Gelfand et al.
5,806,512 A 9/1998 Abramov et al.
5,830,164 A 11/1998 Cone et al.
5,833,711 A 11/1998 Schneider, Sr. et al.
5,848,878 A 12/1998 Conti et al.
5,891,062 A 4/1999 Schock et al.
5,910,071 A 6/1999 Hougen
5,997,488 A 12/1999 Gelfand et al.
6,022,328 A 2/2000 Hailey
6,030,353 A 2/2000 Van Brunt
6,036,662 A 3/2000 Van Brunt et al.
6,066,101 A 5/2000 Johnson et al.
6,068,602 A 5/2000 Tham et al.
6,155,996 A 12/2000 Van Brunt et al.
6,174,295 B1 1/2001 Cantrell et al.
6,179,793 B1 1/2001 Rothman et al.
6,193,678 B1 2/2001 Brannon
6,210,345 B1 4/2001 Van Brunt
6,254,556 B1 7/2001 Hansen et al.
6,340,025 B1 1/2002 Van Brunt
6,379,316 B1 4/2002 Van Brunt et al.
6,415,791 B1 7/2002 Van Brunt
6,468,237 B1 10/2002 Lina
6,471,663 B1 10/2002 Van Brunt et al.
6,488,641 B2 12/2002 Hansen
6,547,749 B2 * 4/2003 Hansen ..... 601/48
6,736,785 B1 5/2004 Van Brunt
6,764,455 B2 7/2004 Van Brunt et al.
6,910,479 B1 6/2005 Van Brunt
7,018,348 B2 3/2006 Van Brunt et al.
7,115,104 B2 10/2006 Van Brunt et al.
7,121,808 B2 10/2006 Van Brunt et al.
2003/0028131 A1 2/2003 Van Brunt et al.
2003/0206811 A1 * 11/2003 Maki et al. ..... 417/222.1
2004/0097842 A1 * 5/2004 Van Brunt et al. ..... 601/41
2004/0097843 A1 5/2004 Van Brunt et al.
2004/0097844 A1 5/2004 Van Brunt et al.
2004/0097845 A1 5/2004 Van Brunt
2004/0097846 A1 5/2004 Van Brunt et al.
2004/0097847 A1 5/2004 Van Brunt et al.
2004/0097848 A1 5/2004 Van Brunt et al.
2004/0097849 A1 5/2004 Van Brunt
2004/0176709 A1 9/2004 Van Brunt
2006/0009718 A1 1/2006 Van Brunt et al.
2006/0088425 A1 * 4/2006 Lucas et al. ..... 417/269
2007/0004992 A1 1/2007 Van Brunt et al.

OTHER PUBLICATIONS

The VEST™ Airway Clearance System, Hill-Rom, 2001-2004, four pages.
The VEST™ Airway Clearance System, Hill-Rom, 2003-2004, eight pages.

* cited by examiner 12
14
46
46
26
24
46
46
44
44
10
16
18
22
22
40
38
42
36
30
36
36
32
20
28
34
118

VARIABLE STROKE AIR PULSE GENERATOR

This application claims priority under 35 U.S.C. §119(e) to U.S. Provisional application Ser. No. 60/726,554, filed Oct. 14, 2005, which is expressly incorporated by reference herein.

BACKGROUND

The present invention relates to air pulse generators for use with high frequency chest wall oscillation devices. More particularly, the present invention relates to an air pulse generator with adjustable outputs.

High frequency chest wall oscillation (HFCWO) systems having air pulse generators that deliver air pulses to a garment, such as a vest or chest wrap, worn by a patient. HFCWO devices are used to treat people who have respiratory ailments which require mechanical stimulation of the lungs to break up fluid or secretions which accumulate in the lungs such that the fluid or secretions are more easily expelled. For example, people with cystic fibrosis require regular respiratory therapy in the form of manual percussion and vibration of the lungs to break loose secretions in the lungs as a result of their disease.

In some instances, it is desirable to adjust the therapy delivered depending on the needs of the particular patient. For example, the magnitude of oscillation that may be suitable for a large or obese patient is different than the magnitude of oscillation suitable for a small child. Various adjustments may be made in the therapy such as altering the size of a garment worn by the person receiving the therapy. Additionally, the therapy a particular patient receives may vary in frequency. Some adjustments of therapy depend on considerations such as activity level, weather conditions, and overall health.

SUMMARY

The present disclosure comprises one or more of the features recited in the appended claims and/or the following features which, alone or in any combination, may comprise patentable subject matter:

An apparatus for high frequency chest wall oscillation, such as that used for the therapeutic intervention for an individual with a respiratory disease such as cystic fibrosis, for example, may comprise a patient interface and an air pulse generator in fluid communication with the patient interface. The air pulse generator may be configured to cyclically deliver pulses of air to the patient interface to induce oscillation of the chest wall of a patient.

The patient interface may comprise an inflatable chamber and a retainer to maintain the chamber in contact with the patient during use. Illustratively, the patient interface comprises a vest garment secured with book and loop fasteners. In other embodiments, the patient interface may be secured to the patient with straps, buckles, belts, harnesses, or the like. The inflatable chamber may be a semi-airtight cavity formed by sewing two layers of the garment together to form a volume enclosed by the seams sewn into the garment. In some embodiments, the inflatable chamber may be a substantially airtight air bladder inserted into a pocket formed in the garment. In some embodiments, the retainer may be embodied as a different garment such as a wrap which wraps around the chest of a patient, for example. The inflatable chamber may include a port which facilitates the coupling of a conduit such as a hose to be connected to the port and provide fluid communication between the chamber and the conduit.

The air pulse generator may comprise a fluid chamber having a variable volume. The fluid chamber may be in fluid communication with the inflatable chamber of the patient interface through the conduit. Illustratively, the conduit is a hose. The fluid chamber may have one or more ports which facilitates coupling of the conduit to provide a fluid path between the fluid chamber and the inflatable chamber. In some embodiments, the patient interface may comprise multiple inflatable chambers with each inflatable chamber in fluid communication with the air chamber through one or more conduits coupled to the fluid chamber through the one or more ports.

The fluid chamber may comprise an additional port to provide a coupling point for a conduit from a source of pressurized air such as a blower, for example. The blower may be configured to develop a static pressure between the blower, air chamber, conduits, and inflatable chamber. The static pressure may result from a constant flow from the blower with any excess pressure being lost through losses in the fluid circuit comprising the blower, inflatable chamber(s), conduit(s), and air chamber. For example, if additional flow cannot be achieved, excess flow and thereby, pressure, may be lost through inefficiency in the blower. Other loss points in the circuit may be formed to manage the level of the static pressure. For example, the inflatable chamber may be perforated to permit air to escape, or the circuit may include a relief valve. Also, in some embodiments, the blower speed may be altered to adjust the static pressure in the system.

In use, the fluid circuit operates at a steady state pressure. The volume of the air chamber may be rapidly reduced to develop a pressure in the system higher than the steady state pressure and thereby further pressurize the inflatable chamber. Expansion of the inflatable chamber applies pressure to the chest wall of the patient and thereby oscillates the chest wall. Rapid expansion of the air chamber may reduce the pressure in the system to permit the inflatable chamber to contract. Communication of repetitive air pulses to the inflatable chamber results in repetitive oscillation of the chest wall of the patient.

The air chamber may comprise a volume bounded at least in part by a movable member which moves through a displacement to alter the volume of space within the confines of the air chamber. In some embodiments, the movable member may comprise a piston which moves relative to the air chamber. In other embodiments, the movable member may comprise a diaphragm which moves relative to the air chamber.

The movable member may be driven by a driver such as a motor coupled to the movable member through a linkage configured to translate output from the motor to cyclically displace the movable member and thereby alter the volume of the air chamber to provide air pulses to the fluid circuit. The driver may be a variable speed driver so that the frequency of air pulses delivered by the air pulse generator may be altered. Further, the linkage may be adjustable such that the displacement of the movable member is variable to deliver any of a number of different volumes of air pulse from the air pulse generator.

In an illustrative embodiment, the linkage comprises a drive arm coupled to the driver, a connecting arm coupled to the drive arm through a pivot pin and pivotably coupled to the movable member, and a control arm coupled to the pivot pin and pivotably coupled to a ground link. The drive arm is coupled to the driver such that eccentric rotary motion of the driver is transferred through the drive arm to the pivot pin. The connecting arm is pivotably coupled to the pivot pin such that motion from the drive arm is transferred to displace the movable member. The control arm is pivotably coupled to the ground link to pivot relative to the ground link about a ground pivot axis and pivotably coupled to the pivot pin so that motion of the pivot pin is restrained by the control arm to an arcuate path centered on the ground pivot axis. The linkage is configured to convert generally rotational motion of the driver into generally linear displacement of the movable member.

Displacement of the movable member may be controlled by the relative movement of the pivot pin normal to the movable member. Positioning of the ground pivot axis may control the path of the pivot pin. Varying the position of the ground pivot axis may vary the displacement of the movable member. For example, if the line between the center of the pivot pin and the ground pivot axis is perpendicular to the direction of displacement of the movable member, then the amount of displacement will be maximized. Likewise, if the line between the center of the pivot pin and the ground pivot axis is parallel to the direction of displacement of the movable member, then the amount of displacement will be minimized.

In some embodiments, the ground link may be adjustable to alter the position of the ground pivot axis and thereby alter the magnitude of displacement of the movable member. Adjustment of the ground link may be automatically controlled by an actuator. In the illustrative embodiment, the ground link is coupled to a spur gear. The spur gear is pivotable about a central axis parallel to the ground pivot axis. Pivoting of the spur gear about the central axis adjusts the ground pivot axis to a number of positions about the central axis.

Illustratively, rotation of the spur gear is driven by a worm gear engaged with the spur gear. The worm gear is driven by a motor. The motor may rotate the worm gear in a first direction and a second direction opposite the first direction resulting in rotation of the spur gear and, thereby, the ground link in first and second directions. In other embodiments, the ground link may be positioned by an electromechanical linear actuator.

The air pulse generator may further include multiple user input devices such as buttons, dials, switches, or the like. In addition, the air pulse generator may include a number of display devices such as a liquid crystal display (LCD), pressure gauges, flow gauges, lights, and/or light-emitting diodes (LED's). The user input devices and display devices may be grouped into a user interface coupled to the frame of the air pulse generator.

A user may control operation of the air pulse generator by adjusting the motor speed, ground link position through the user interface. In some embodiments, the user interface may be coupled to a controller configured to receive user inputs and monitor operational conditions to control the air pulse generator output based on parameters input by a user. For example, the controller may receive a particular static pressure, air pulse volume, and air pulse frequency from the user inputs and control the position of the ground link, the motor speed, and the blower speed to operate the air pulse generator in accordance with the specified operational parameters.

In some embodiments, the controller may further include a memory device to store programmed operation conditions which may be selected as the operational parameters of the air pulse generator for a particular user. The operating conditions may be programmed to vary over time such that the frequency and volume of air pulses varies to thereby provide a therapy cycle. The memory device may be configured to store multiple profiles which may be selected so that the apparatus may be used by multiple users, with each user having one or more different therapy profiles.

The controller may operate on a closed-loop basis to monitor particular output parameters such as ground link position, motor speed, blower speed, static pressure, peak pressure, air pulse frequency, and the like, and other input parameters to achieve the appropriate therapy operational parameters.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
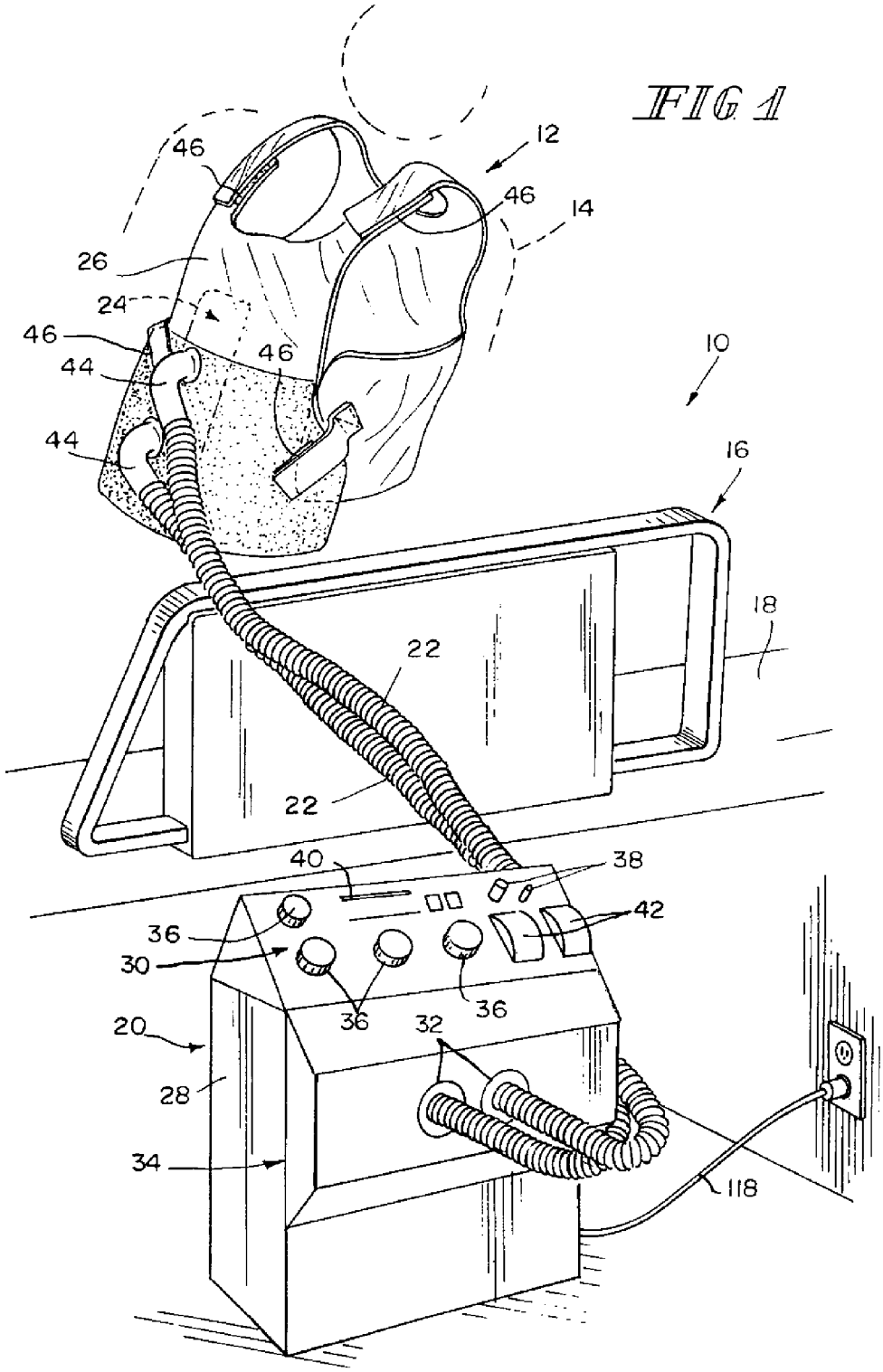
FIG. 1 is a perspective view of a high frequency chest wall oscillation apparatus including a patient interface comprising a vest-like garment and an air pulse generator.

An apparatus 10 for applying high frequency chest wall oscillation (HFCWO) to a patient 14 comprises a patient interface 12 and an air pulse generator 20 in fluid communication with the patient interface 12 through hoses 22 as shown in FIG. 1. HFCWO involves application of mechanical forces to the chest of a person. Air pulse generator 20 inflates chamber 24 in the patient interface 12 to a steady state level of inflation and provides air pulses to expand chamber 24 to thereby oscillate the patient's chest. By repeating the rapid expansion of chamber 24 over time, the chest wall oscillates resulting mucous or other buildup in the lung tissues of a patient being broken loose.

In the illustrative embodiment, patient interface 12 is embodied as a vest garment 26 which includes a chamber 24. Two conduits embodied as a hoses 22 interface with chamber 24 through two couplings 44 and with an air chamber 34 of air pulse generator 20 through two outlets 32. Outlets 32, hoses 22, and couplings 44 provide an open fluid path between air chamber 34 and chamber 24 such that chamber 24 and air chamber 34 are in constant fluid communication. In other embodiments, patient interface 12 may comprise multiple chambers 24 with a different conduit communicating with each of the chambers 24. The configuration of the patient interface 12 including the number and position of chambers 24 may be selected based on the therapy to be delivered as dictated by the diagnosis of the person using the device.

Vest garment 26 is worn by a patient 14 while patient 14 receives therapy and is secured to the patient 14 by a hook and loop fasteners 46. Hook and loop fastener 46 secures the vest garment 26 such that vest garment 26 maintains close contact with patient 14 during therapy. In some embodiments, vest garment 26 may comprise an elastic or semi-elastic fabric to assist in providing a secure fit with close contact between patient 14 and vest garment 26. In some embodiments, the hook and loop fastener 46 may be omitted and replaced with another garment fastening system such as buttons, zippers, belts, or the like.

In the illustrative embodiment, chamber 24 is formed by sewing two layers of fabric together to form a semi-airtight space therebetween with coupling 44 providing fluid communication with the chamber formed by the layers and seam. In other embodiments, chamber 24 may be an air bladder retained within a pocket sewn in the vest garment 26. In the illustrative embodiment, the fabric is a non-elastic material, but elastic material may be used if desired.

Air pulse generator 20 comprises a cabinet 28, an interface panel 30, an air chamber 34, and outlets 32 which are configured to receive hoses 22. Interface panel 30 includes several user input devices such as dials 36, and buttons 38. Additionally, interface panel 30 includes a display panel 40 and pressure gauges 42.

Figure 2:
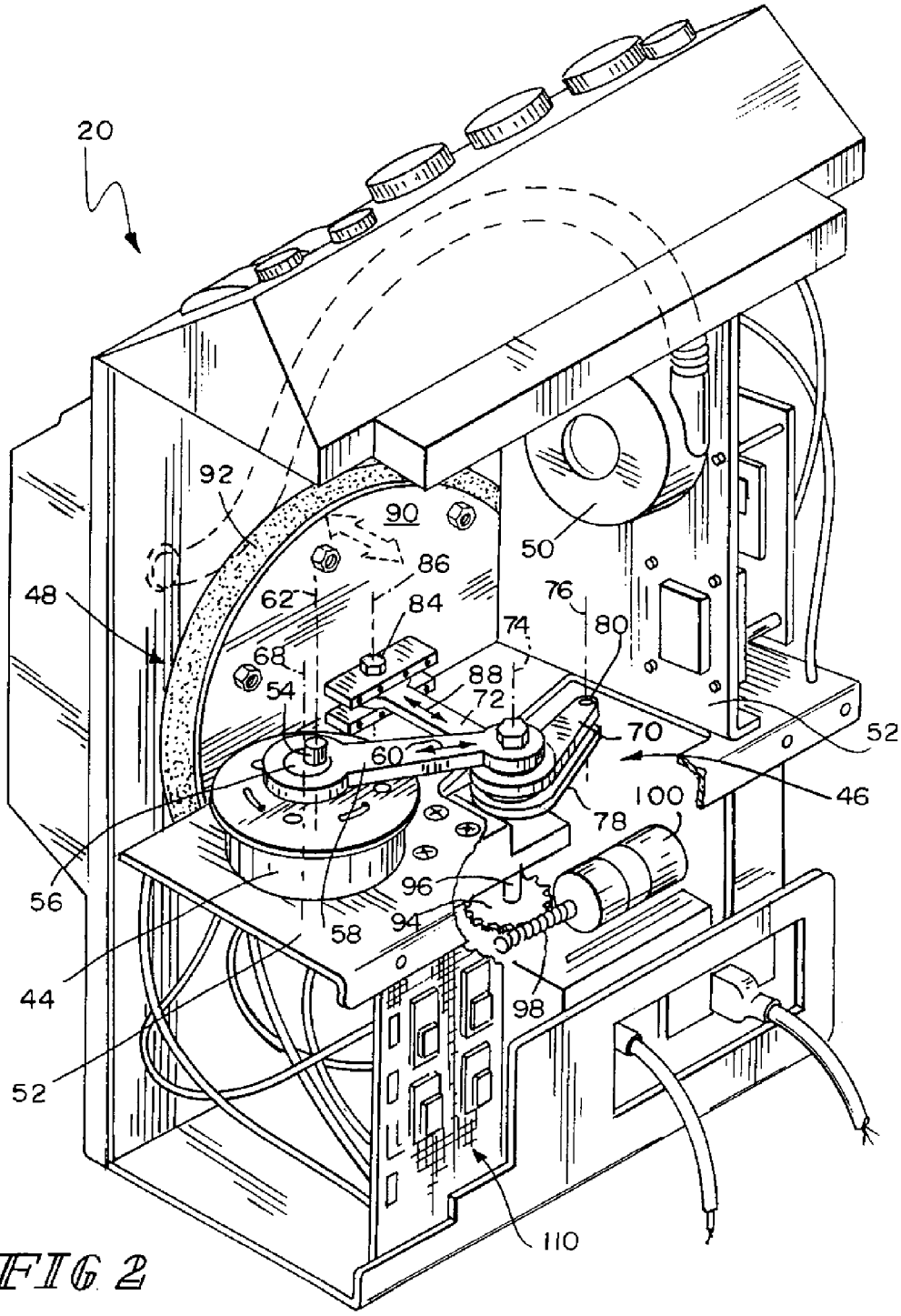
FIG. 2 is a perspective view of the back of the air pulse generator of FIG. 1 with portions removed, the air pulse generator comprising an adjustable stroke linkage.

Air pulse generator further comprises a motor 44 coupled to a frame 52, a linkage 46 coupled to motor 44 and a diaphragm assembly 48, and a blower 50 coupled to a frame 52 of air pulse generator 20, as shown in FIG. 2. Motor 44 includes an output 54 with an eccentric member 56 which provides eccentric rotational motion as motor 44 turns. Linkage 46 includes a drive link 58 which is driven by output 54 of motor 44. The eccentric member 56 rotates within drive link 58 and thereby imparts an oscillating motion to drive link 58 as is represented by arrow 60. Output 54 rotates about an axis 62 and eccentric member 56 is centered on axis 68. Rotation of output 54 results in rotation of axis 68 about axis 62 to provide the oscillation of drive link 58.

Motion of drive link 58 is restrained by the coupling of drive link 58 to other members of the linkage 46. Drive link 58 is pivotably coupled to a control link 70 and a connecting arm 72 through a pin 74. Control link 70 is pivotably coupled to a ground link 78 through a pin 80 which is centered on an axis 76. Control link 70 is restrained to pivot about axis 76 which limits the motion of pin 74 to a radial path 82 (seen in FIGS. 4A-4D) centered on axis 76.

Connecting arm 72 is pivotably coupled to diaphragm assembly 48 through a pin 84, the centerline of which defines an axis 86. The oscillating motion of drive link 58 is controlled by control link 70 and converted to oscillating motion of connecting arm 72 as represented by arrow 88. The oscillation of connecting arm 72 is transferred to a plate 90 which forms part of air chamber 34. Air chamber 34 is also bounded by a membrane 92 which is coupled to plate 90. Membrane 92 is an elastic material such as rubber or neoprene which is flexible and/or stretchable. In some embodiments, membrane 92 may be replaced by a bellows or other expandable material. Oscillation of connecting arm 72 and plate 90 tends to expand and relax membrane 92. Because the remainder of air chamber 34 is fixed, expansion and relaxation of membrane 92 results in changing the volume of air chamber 34. A rapid change from a larger volume to a smaller volume results in generation of an air pulse transmitted through hoses 22 to the chamber 24.

The volume of air pulse generated is directly related to the magnitude of displacement of plate 90 which controls the expansion of membrane 92 and thereby the volume of air chamber 34. Displacement of plate 90 is controlled by the magnitude of oscillation of control arm 72. Referring now to FIGS. 4A-4D, it can be seen that the position of axis 76 relative to axis 86 controls the displacement of plate 90 by changing the orientation of radial path 82 relative to axis 86. Referring to FIGS. 4C and 4D, axis 76 is near connecting arm 72 such that radial path 82 is oriented so that much of the oscillation of drive link 58 is in a direction parallel to plate 90 with only minimal oscillation transferred perpendicular to plate 90, thereby limiting the displacement of plate 90.

Figure 4A:
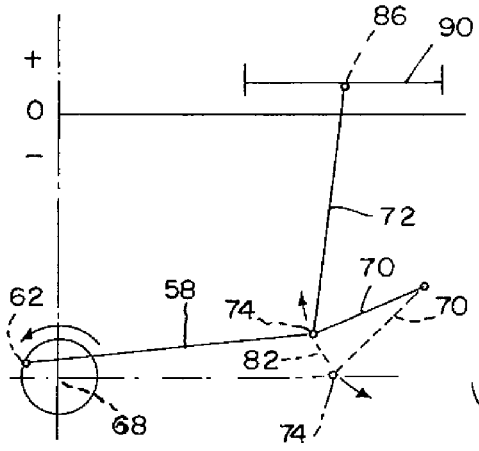
FIG. 4A is a schematic view of the adjustable stroke linkage of FIG. 2 with a moving portion at a maximum displacement when a ground link of the air pulse generator is in a first position.
Figure 4B:
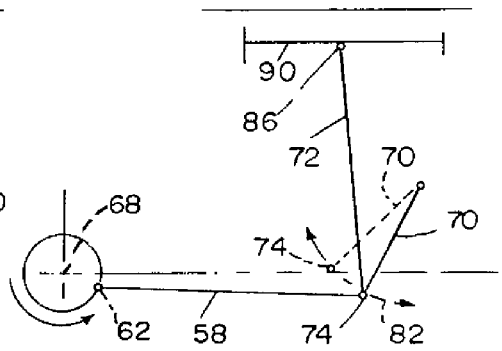
FIG. 4B is a schematic view of the adjustable stroke linkage of FIG. 2 with a moving portion at a minimum displacement when the ground link is in the first position.
Figure 4C:
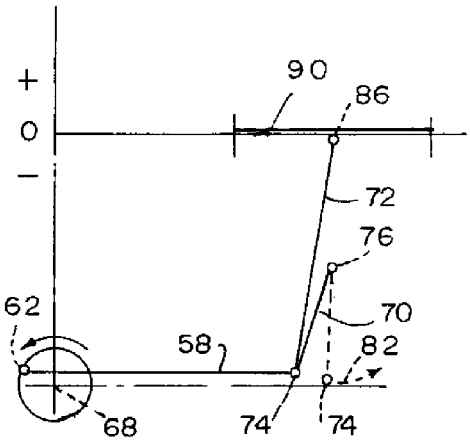
FIG. 4C is a schematic view of the adjustable stroke linkage of FIG. 2 with a moving portion at a maximum displacement when the ground link is in a second position.
Figure 4D:
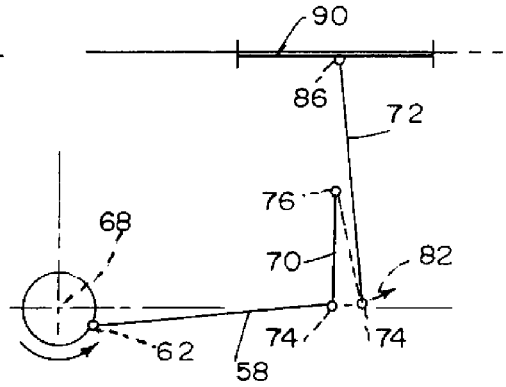
FIG. 4D is a schematic view of the adjustable stroke linkage of FIG. 2 with a moving portion at a minimum displacement when the ground link is in the second position.

In contrast, the position of axis 76 in FIGS. 4A and 4B is away from connecting arm 72 and axis 86 resulting in more of the oscillation being oriented perpendicular to plate 90 thereby increasing the magnitude of displacement of plate 90. In the present disclosure, adjustment of the position of axis 76 provides an adjustment to the displacement of plate 90, thereby varying the volume of air pulses generated by the air pulse generator 20.

In the illustrative embodiment, control of the position of axis 76 is accomplished by an adjuster which rotates the ground link 78 which thereby moves pin 80 which provides the pivotable connection for control link 70 to ground link 78. The adjuster is embodied as a spur gear 94, worm gear 98, and motor 100. Ground link 78 is coupled to spur gear 94 through a shaft 96. Spur gear 94 meshes with worm gear 98 coupled to an output of motor 100. Rotation of worm gear 98 of motor 100 drives rotation of spur gear 94 which changes the position of axis 76 and thereby alters the displacement of plate 90. In other embodiments, the ground link may be rotated or otherwise repositioned by a linear actuator such as an electromechanical linear actuator.

FIGS. 4A and 4B diagrammatically show plate 90 in first and second positions respectfully. In FIGS. 4A and 4B, axis 76 is in the same position. However, eccentric member 56 is rotated from a first position in FIG. 4A to a second position in FIG. 4B. In the first position, plate 90 is in a position which allows membrane 92 to relax and minimize the volume in air chamber 34. The change in position from FIG. 4A to 4B represents the displacement of plate 90 in this configuration which correlates to the volume of air pulse generated.

In FIGS. 4C and 4D, axis 76 is in a common position different from that of FIGS. 4A and 4B. Specifically, axis 76 lies nearer axis 86 in FIGS. 4C and 4D as compared to FIGS. 4A and 4B. Radial path 82 is oriented so that much of the oscillation of drive link 58 is controlled by control link 70 to be parallel to plate 90 and thereby minimize displacement of plate 90. Plate 90 is shown in a first position in FIG. 4C and in a second position in FIG. 4D. It can be seen that the magnitude of displacement of plate 90 in FIGS. 4C and 4D is smaller than the magnitude of displacement of plate 90 in FIGS. 4A and 4B. Ground link 78 is adjustable to move axis 76 through approximately 90 degrees between a position in which axis 76 lies on a line parallel to plate 90 and a position in which axis 76 lies on a line perpendicular to plate 90. Adjustment of the position of axis 76 permits the volume of air pulses generated to be adjusted to a plurality of values within a range of maximum and minimum values.

In addition to the volume of air pulses generated, the frequency of air pulses may also be adjusted apparatus 10. This permits the therapy delivered to a patient to be adjusted by a caregiver to the specific requirements of the given patient. Frequency of air pulses is controlled by controlling the speed of output 54 of motor 44. In the illustrative embodiment, motor 44 is a variable speed DC motor. Motor 44 as well as blower 50 and motor 100 are controlled by a controller 110 shown in FIG. 2.

Figure 3:
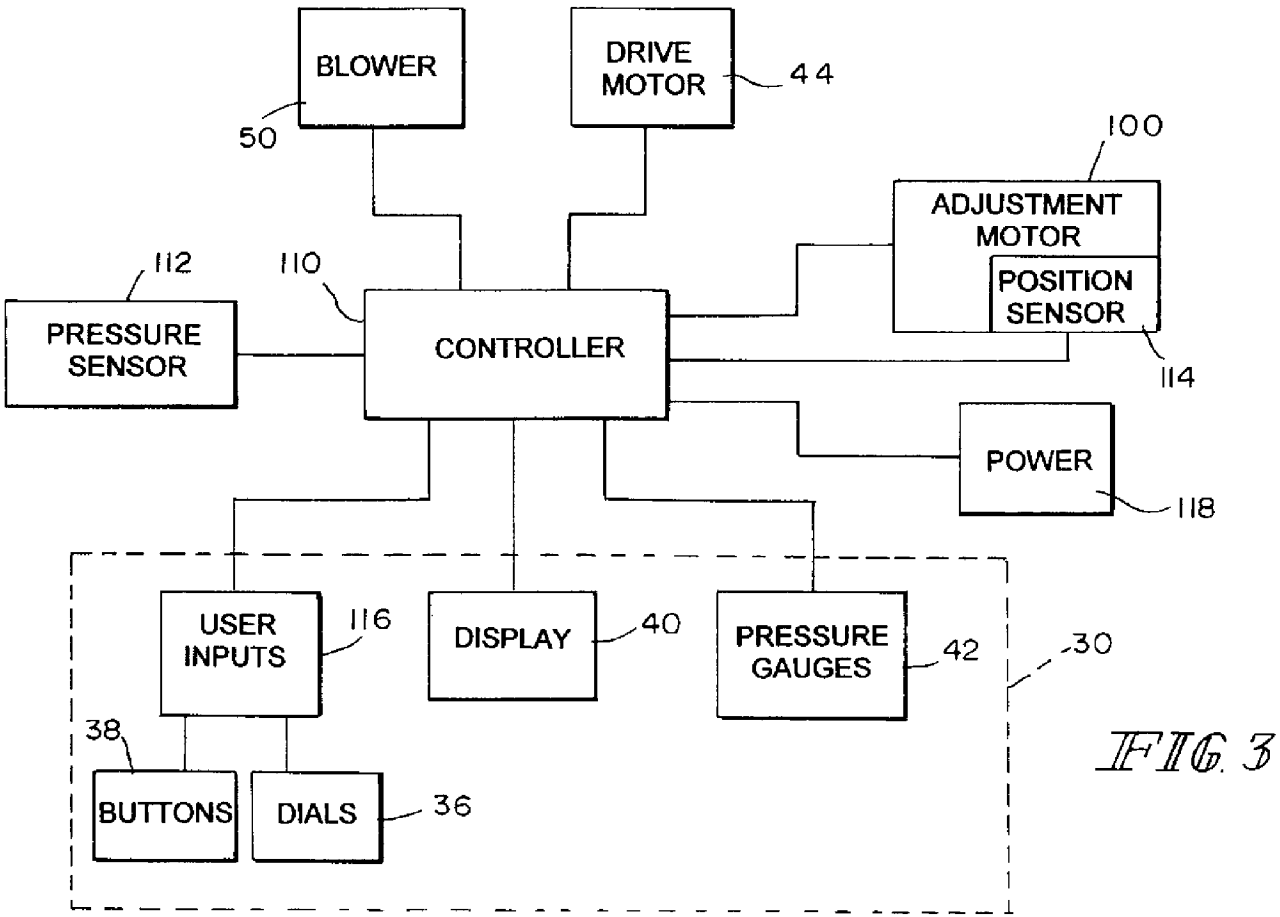
FIG. 3 is a block diagram of a control system of the air pulse generator of FIG. 1.

Referring now to FIG. 3, a schematic for air pulse generator 20 shows the relationship of controller 110 to other components of the air pulse generator 20. Controller 110 receives power through a power cord 118 and distributes the power to the various components of the air pulse generator 20. In some embodiments, power cord 118 may supply power to an additional power conditioning board that subsequently supplies power to various components of the air pulse generator 20. Alternatively, power may be supplied by a battery in lieu of mains power through power cord 118. The controller 110 is operable to control blower 50, drive motor 44, adjustment motor 100 and to output information to display 30 and pressure gauges 42. The controller 110 acts on inputs received from a position sensor 114 on the adjustment motor 100, pressure sensors 112, and user inputs 116 such as the dials 36 and buttons 38. In some embodiments the controller 110 acts to control outputs based directly on inputs provided by a user through the user inputs 116. The user simply adjusts the user inputs 116 to achieve an operational level of the air pulse generator 20 desired with the user responding to outputs displayed on the display 40 and the pressure gauges 42.

The controller 110 comprises a microprocessor, embedded software, memory devices, and timing devices. The controller 110 is configured to receive inputs from user inputs 116 and monitor operational conditions to perform closed loop control of operation of the air pulse generator 20. The controller 110 stores particular operating conditions for a particular user to be recalled and is configured to execute operation of the air pulse generator 20 for that user. In some cases, the operating conditions may be variable over time. For example, a particular patient may require a therapy regimen which calls for minimal chest wall oscillation at a low frequency with both the volume of pulses and frequency of pulses increasing over time. The controller 110 is programmable to vary the frequency and volume of air pulses to accomplish a time variable regimen.

The static pressure in the system is defined by the output of blower 50 and the amount of losses in the system. The air pulses occur as pressure pulses generally superimposed over the static pressure. The controller 110 is configured to control the static pressure in addition to the volume of air pulses. By controlling the speed of blower 50, controller 110 controls the static pressure. Therefore, static pressure is a variable which may be varied over time as desired to provide an appropriate therapy regimen to a patient.

The combination of control of the operational static pressure, frequency of air pulses, and volume of air pulses over time allows a caregiver to optimize a therapy regimen for a particular patient. The ability to save various therapy regimens in the apparatus 10 provides the patient 14 the ability to begin therapy at a time and place that is convenient for the patient 14 thereby increasing the probability of compliance with the therapy over time.

Embodiments disclosed herein refer to the use of an actuator. The term actuator refers to any of a number of actuation devices which may be utilized in articulating various members and linkages in the disclosed apparatus. For example, electromechanical linear actuators, pneumatic cylinders, hydraulic cylinders, and air bladders are all contemplated as being applicable to one or more of the embodiments. Additionally, actuators may include other combinations of prime movers and links or members which may be utilized to actuate, move, transfer motion, articulate, lift, lower, rotate, extend, retract, or otherwise move links, linkages, frames, or members of the apparatus.

Although certain illustrative embodiments have been described in detail above, variations and modifications exist within the scope and spirit of this disclosure as described and as defined in the following claims.

The invention claimed is:

1. An apparatus for high frequency chest wall oscillation, the apparatus comprising a garment adapted to be worn by a person and having an inflatable chamber, and an air pulse generator in fluid communication with the inflatable chamber and operable to deliver air pulses to the inflatable chamber, the air pulse generator comprising an air chamber bounded at least in part by a movable member which moves through a displacement to create the air pulse and a linkage including a connecting arm pivotably coupled to the movable member, a drive arm, an adjustment arm, and a ground link, wherein the volume of the air pulses delivered to the inflatable chamber is adjustable by varying the magnitude of the displacement of the movable member.

2. The apparatus of claim 1, wherein the air pulse generator further comprises a driver coupled to the drive arm.

3. The apparatus of claim 2, wherein the driver is adjustable to adjust the frequency of air pulses.

4. The apparatus of claim 1, wherein the air pulse generator automatically varies the volume and frequency of air pulses over time.

5. The apparatus of claim 1, wherein the air pulse generator is programmable to automatically vary the volume and frequency of air pulses over time.

6. The apparatus of claim 5, wherein the air pulse generator further comprises a memory device for storing multiple therapy profiles.

7. The apparatus of claim 6, wherein the air pulse generator further includes a variable speed blower operable to develop a static pressure such that the volume of air pulses generated increase the pressure in the system to a value greater than the static pressure.

8. The apparatus of claim 7, wherein the blower speed is variable over time to vary the static pressure.

9. An air pulse generator for a high frequency chest wall oscillator having an inflatable garment worn by a person, the air pulse generator comprising a motor with an output, a variable volume air chamber coupleable to the inflatable garment, a moveable member defining a portion of the variable volume air chamber, and a linkage coupling the output of the motor to the moveable member, the motor acting through the linkage to cyclically move the moveable member to create air pulses, the linkage being adjustable to vary a volume of the air pulses delivered to the inflatable garment, wherein the linkage comprises a connecting arm, a drive arm coupled at a first pivot point to the connecting arm, an adjustment arm coupled at the first pivot point to the connecting arm, and a ground link.

10. The air pulse generator of claim 9, further comprising a controller coupled to the motor, an adjustment actuator coupled to the controller and the linkage, and a user input coupled to the controller, wherein a user varies inputs to control the motor speed and volume of air pulses generated.

11. The air pulse generator of claim 10, wherein the adjustment actuator is a linear actuator.

12. The air pulse generator of claim 9, wherein the adjustment actuator moves the ground link to adjust the volume of air pulses delivered to the chest wall oscillator.

13. The air pulse generator of claim 9, wherein the connecting arm is pivotably coupled to the movable member.

14. An air pulse generator for a high frequency chest wall oscillator comprising a diaphragm, a first link coupled to the diaphragm, a motor with a rotational output, a drive arm coupled to the output for eccentric motion relative thereto and coupled to the first link to translate rotation of the motor to the first link to cyclically displace the diaphragm, a control arm coupled to the first link, a second link coupled to the control arm and adjustable to vary displacement of the diaphragm, a spur gear coupled to the second link, and an adjuster having a worm gear intermeshing with the spur gear, wherein actuation of the adjuster rotates the spur gear to adjust the second link to change the magnitude of displacement of the diaphragm.

15. The air pulse generator of claim 14, wherein the motor is a variable speed motor.

16. The air pulse generator of claim 14, further comprising a variable speed motor, a controller coupled to the motor and the adjuster, and a user input coupled to the controller, the user input including a display and user input devices, wherein a user adjusts the user input devices to vary the motor speed and adjust the second link to thereby vary the frequency and volume of air pulses.

17. The air pulse generator of claim 16, further comprising a memory device coupled to the controller and configured to store a sequence of air pulse frequency and volume changes, the controller operable to execute the sequence over time to provide a specific therapy profile.

18. The air pulse generator of claim 17, wherein the memory device stores a plurality of sequences and a user may access a specific sequence to be executed.

19. The air pulse generator of claim 16, wherein the controller automatically varies motor speed and the adjuster over time to vary the air pulse volume and frequency administered by the air pulse generator.

* * * * *